US007626471B2

(12) United States Patent
Kishimoto et al.

(10) Patent No.: US 7,626,471 B2
(45) Date of Patent: Dec. 1, 2009

(54) NON-RECIPROCAL CIRCUIT DEVICE

(75) Inventors: Yasushi Kishimoto, Tottori (JP); Takefumi Terawaki, Tottori (JP)

(73) Assignee: Hitachi Metals, Ltd., Tokyo (JP)

( * ) Notice: Subject to any disclaimer, the term of this patent is extended or adjusted under 35 U.S.C. 154(b) by 34 days.

(21) Appl. No.: 12/091,599

(22) PCT Filed: Oct. 30, 2006

(86) PCT No.: PCT/JP2006/321683

§ 371 (c)(1),
(2), (4) Date: Apr. 25, 2008

(87) PCT Pub. No.: WO2007/049789

PCT Pub. Date: May 3, 2007

(65) Prior Publication Data

US 2009/0045884 A1 Feb. 19, 2009

(30) Foreign Application Priority Data

Oct. 28, 2005 (JP) ..... 2005-314648
Apr. 13, 2006 (JP) ..... 2006-110541

(51) Int. Cl.
*H01P 1/32* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 6,696,901 B1 2/2004 Takeda et al.
2004/0004521 A1 1/2004 Hasegawa

FOREIGN PATENT DOCUMENTS

JP 2004-088743 A 3/2004
JP 2004-088744 A 3/2004
JP 2005-102143 A 4/2005
WO 00/59065 A1 10/2000

*Primary Examiner*—Stephen E Jones
(74) *Attorney, Agent, or Firm*—Sughrue Mion, PLLC

(57) ABSTRACT

A non-reciprocal circuit device comprising a first inductance element L1 disposed between a first input/output port P1 and a second input/output port P2, a first capacitance element Ci parallel-connected to the first inductance element L1 to constitute a first resonance circuit, a resistance element R parallel-connected to the first parallel resonance circuit, a second inductance element L2 disposed between a second input/output port P2 of the first resonance circuit and a ground, a second capacitance element Cfa parallel-connected to the second inductance element L2 to constitute a second resonance circuit, a third inductance element Lg disposed between the second resonance circuit and the ground, and a third capacitance element Cfb disposed between a second input/output port P2 of the first resonance circuit and the ground.

11 Claims, 18 Drawing Sheets

NON-RECIPROCAL CIRCUIT DEVICE

CROSS REFERENCE TO RELATED APPLICATIONS

This application is a National Stage of International Application No. PCT/JP 2006/321683 filed on Oct. 30, 2006, claiming priority based on Japanese Patent Application Nos. 2005-314648 and 2006-110541, filed Oct. 28, 2005 and Apr. 13, 2006, the contents of all of which are incorporated herein by reference in their entirety.

FIELD OF THE INVENTION

This invention relates to a non-reciprocal circuit device having non-reciprocal transmission characteristics to high-frequency signals, particularly to a non-reciprocal circuit device suitable for mobile communications systems such as cell phones, etc.

BACKGROUND OF THE INVENTION

Non-reciprocal circuit devices such as isolators are used in mobile communications equipments utilizing frequencies from several hundreds MHz to several tens GHz, such as base stations and terminals of cell phones, etc. In transmission systems of mobile communications equipments, for instance, isolators are disposed between power amplifiers and antennas to prevent unnecessary signals from returning to the power amplifiers, thereby stabilizing the impedance of the power amplifiers on the load side. Accordingly, the isolators are required to have excellent insertion loss characteristics, reflection loss characteristics and isolation characteristics.

Conventionally known as such isolators is a three-terminal isolator shown in FIG. 26. This isolator comprises three central conductors 31, 32, 33 crossing at an angle of 120° with electric insulation on one main surface of a ferrimagnetic microwave ferrite 38, each central conductor 31, 32, 33 having one end connected to the ground and the other end connected to a matching capacitor C1-C3, and a terminal resistor Rt is connected to a port (for instance, P3) of one of the central conductors 31, 32, 33. A DC magnetic field Hdc is axially applied from a permanent magnet (not shown) to the ferrite 38. This isolator transmits high-frequency signals from a port P1 to a port P2, while absorbing reflection waves from the port P2 by the terminal resistor Rt to prevent them from being transmitted to the port P1, thereby preventing unnecessary reflection waves generated by the impedance variation of an antenna from entering a power amplifier, etc.

Attention has recently been getting paid to a two-port isolator comprising two central conductors and having excellent insertion loss characteristics and reflection characteristics (JP 2004-88743 A). FIG. 27 shows a equivalent circuit of the two-port isolator, and FIG. 28 shows its structure.

This two-port isolator 1 comprises a central electrode L1 (first inductance element) electrically connected between first and second input/output ports P1, P2, a central electrode L2 (second inductance element) crossing the central electrode L1 with electric insulation and electrically connected between the second input/output port P2 and the ground, a capacitance element C1 electrically connected between the first and second input/output ports P1, P2 to constitute a first parallel resonance circuit with the central electrode L1, a resistance element R, and a capacitance element C2 electrically connected between the second input/output port P2 and the ground to constitute a second parallel resonance circuit with the central electrode L2. A frequency providing the maximum isolation (attenuation in reverse direction) is set by the first parallel resonance circuit, and a frequency providing the minimum insertion loss is set by the second parallel resonance circuit. When high-frequency signals are transmitted from the first input/output port P1 to the second input/output port P2, resonation occurs not in the first parallel resonance circuit between the first and second input/output ports P1, P2, but in the second parallel resonance circuit, resulting in small transmission loss and good insertion loss characteristics. Current inversely flowing from the second input/output port P2 to the first input/output port P1 is absorbed by the resistance element R connected between the first and second input/output ports P1, P2.

As shown in FIG. 28, the two-port isolator 1 comprises metal cases (upper case 4 and lower case 8) made of a ferromagnetic material such as soft iron, etc. to constitute a magnetic circuit, a permanent magnet 9, a central conductor assembly 30 comprising a microwave ferrite 20 and central conductors 21, 22, and a laminate substrate 50 on which the central conductor assembly 30 is mounted. Each case 4, 8 is plated with a conductive metal such as Ag, Cu, etc.

The central conductor assembly 30 comprises a disk-shaped microwave ferrite 20, and central conductors 21, 22 perpendicularly crossing thereon via an insulating layer (not shown). The central conductors 21, 22 are electromagnetically coupled to each other in crossing portions. Each central conductor 21, 22 is constituted by two lines, both end portions thereof separately extending along a lower surface of the microwave ferrite 20.

As shown in FIG. 29, the laminate substrate 50 comprises connecting electrodes 51-54 connected to end portions of the central conductors 21, 22, a dielectric sheet 41 having capacitor electrodes 55, 56 and a resistor 27 on the rear surface, a dielectric sheet 42 having a capacitor electrode 57 on the rear surface, a dielectric sheet 43 having a ground electrode 58 on the rear surface, and a dielectric sheet 45 having an external input electrode 14, an external output electrode 15 and external ground electrodes 16. The connecting electrode 51 acts as the first input/output port P1, and the connecting electrodes 53, 54 act as the second input/output port P2.

The central conductor 21 has one end electrically connected to an external input electrode 14 via the first input/output port P1 (connecting electrode 51), and the other end electrically connected to an external output electrode 15 via the second input/output port P2 (connecting electrode 54). The central conductor 22 has one end electrically connected to an external output electrode 15 via the second input/output port P2 (connecting electrode 53), and the other end electrically connected to an external ground electrode 16. A capacitance element C1 is electrically connected between the first input/output port P1 and the second input/output port P2 to constitute a first parallel resonance circuit with the central conductor L1. A capacitance element C2 is electrically connected between the second input/output port P2 and the ground to constitute a second parallel resonance circuit with the central conductor L2

Cell phones have become handling wider frequency bands (wideband), and pluralities of transmission/receiving systems such as WCDMA, PDC, PHS, GSM, etc. (multi-band, multi-system, etc.) to adapt to increasing numbers of users. Accordingly, non-reciprocal circuit devices have been getting required to be operable in wider frequency bands. One of data transmission technologies, which uses a cell phone network for GSM and TDMA systems, is an enhanced data GSM environment (EDGE). When two bands of GSM850/900 are used, a frequency passband required for the non-reciprocal circuit device is 824-915 MHz.

To obtain a wideband, non-reciprocal circuit device, various factors of causing unevenness, such as inductance generated in lines connecting reactance elements, floating capacitance generated by interference between electrode patterns, etc., should be taken into consideration. In the two-port isolator, however, unnecessary reactance components are connected to the first and second parallel resonance circuits, resulting in the deviation of the input impedance of the two-port isolator from the desired level. As a result, there appears impedance mismatching between the two-port isolator and the other circuits connected thereto, leading to deteriorated insertion loss and isolation characteristics.

Although it is not impossible to determine inductance and capacitance in the first and second parallel resonance circuits taking unnecessary reactance components into consideration, it would be difficult to separately adjust the input impedance of the first and second input/output ports P1, P2 if the width, gap, etc. of lines forming the central conductors 21, 22 were simply changed, so that it has been practically difficult to obtain the optimum conditions of matching with external circuits. This is because the central conductors 21, 22 are coupled to each other, the change of the width, gap, etc. of lines would result in changing the inductance of the first and second inductance elements L1, L2. Particularly deviation in the input impedance of the first input/output port P1 should be avoided because it increases the insertion loss.

OBJECTS OF THE INVENTION

Accordingly, the first object of the present invention is to provide a non-reciprocal circuit device having a wide operation frequency band.

The second object of the present invention is to provide a non-reciprocal circuit device with easy input impedance matching, which has excellent insertion loss characteristics, reflection characteristics and harmonics suppression.

DISCLOSURE OF THE INVENTION

The non-reciprocal circuit device of the present invention comprises a first inductance element L1 disposed between a first input/output port P1 and a second input/output port P2, a first capacitance element Ci parallel-connected to the first inductance element L1 to constitute a first resonance circuit, a resistance element R parallel-connected to the first parallel resonance circuit, a second inductance element L2 disposed between a second input/output port P2 of the first resonance circuit and a ground, a second capacitance element Cfa parallel-connected to the second inductance element L2 to constitute a second resonance circuit, a third inductance element Lg disposed between the second resonance circuit and the ground, and a third capacitance element Cfb disposed between a second input/output port P2 of the first resonance circuit and the ground.

The first inductance element L1 preferably has smaller inductance than that of the second inductance element L2.

An impedance-adjusting means is preferably disposed on the side of the first input/output port P1 of the first resonance circuit. The impedance-adjusting means is preferably constituted by an inductance element and/or a capacitance element, and it is preferably a lowpass or highpass filter.

At least one of the first capacitance element Ci, the second capacitance element Cfa and the third capacitance element Cfb is preferably constituted by pluralities of parallel-connected capacitors. When at least one of plural capacitors is a chip capacitor, the selection of the chip capacitor makes it easy to correct the capacitance of each capacitance element to reduce deviation from the desired capacitance as small as possible.

To obtain excellent electric characteristics, it is important that the first to third capacitance elements Ci, Cfa, Cfb are formed with small unevenness and high precision. From this aspect, as in the equivalent circuit shown in FIG. 7, at least one of the capacitance elements is preferably constituted by pluralities of parallel-connected capacitors.

In the non-reciprocal circuit device of the present invention, the first inductance element L1 and the first capacitance element Ci are adjusted to determine a resonance frequency (called "peak frequency") at which the maximum isolation is obtained, and the second inductance element L2, the third inductance element Lg and the third capacitance element Cfb are adjusted to determine a peak frequency at which the minimum insertion loss is obtained. Thus, the main electric characteristics of the non-reciprocal circuit device can be determined by adjusting the first to third inductance elements L1, L2, Lg and the first and third capacitance elements Ci, Cfb depending on the frequency of a communications system in a communications equipment.

The position of the attenuation pole in a higher-frequency region than the passband can be adjusted without substantially affecting the peak frequency, by selecting the capacitance of the second capacitance element Cfa. Investigate by the inventors has revealed that smaller capacitance has the attenuation pole shift toward a higher frequency side, while larger capacitance has it toward a lower frequency side. Utilizing this behavior, harmonics, particularly a second harmonic, can be relatively easily attenuated.

The first and second inductance elements L1, L2 are preferably constituted by the first and second central conductors 21, 22 disposed on a ferrimagnetic body (microwave ferrite) 10. The third inductance element Lg is preferably constituted by an electrode pattern in the laminate substrate, a chip inductor or a coreless coil mounted on the laminate substrate, lest that it has electromagnetic coupling to the first inductance element L1.

At least part of the first or second capacitance element is preferably constituted by an electrode pattern in the laminate substrate. At least part of the first or second capacitance element may be constituted by a chip capacitor or a single-layer capacitor. The "single-layer capacitor" is a capacitor constituted by electrode patterns formed on the opposing main surfaces of a dielectric substrate.

The third capacitance element Cfb is preferably constituted by an electrode pattern in the laminate substrate, a chip capacitor, or a single-layer capacitor.

An inductance element and/or a capacitance element for the impedance-adjusting means are preferably constituted by electrode patterns in the laminate substrate, or devices mounted on the laminate substrate.

BRIEF DESCRIPTION OF THE DRAWING

FIG. 4(*b*) is a view showing the equivalent circuit of another example of impedance-adjusting means used in the non-reciprocal circuit device of the present invention.

FIG. 4(*c*) is a view showing the equivalent circuit of a further example of impedance-adjusting means used in the non-reciprocal circuit device of the present invention.

FIG. 4(*d*) is a view showing the equivalent circuit of a still further example of impedance-adjusting means used in the non-reciprocal circuit device of the present invention.

FIG. 4(*e*) is a view showing the equivalent circuit of a still further example of impedance-adjusting means used in the non-reciprocal circuit device of the present invention.

FIG. 5(*b*) is a view showing the equivalent circuit of a still further example of impedance-adjusting means used in the non-reciprocal circuit device of the present invention.

FIG. 5(*c*) is a view showing the equivalent circuit of a still further example of impedance-adjusting means used in the non-reciprocal circuit device of the present invention.

FIG. 5(*d*) is a view showing the equivalent circuit of a still further example of impedance-adjusting means used in the non-reciprocal circuit device of the present invention.

FIG. 6(*b*) is a view showing the equivalent circuit of a still further example of impedance-adjusting means used in the non-reciprocal circuit device of the present invention.

FIG. 6(*c*) is a view showing the equivalent circuit of a still further example of impedance-adjusting means used in the non-reciprocal circuit device of the present invention.

FIG. 6(*d*) is a view showing the equivalent circuit of a still further example of impedance-adjusting means used in the non-reciprocal circuit device of the present invention.

FIG. 24(*b*) is a bottom view showing a central conductor used in the non-reciprocal circuit device according to the second embodiment of the present invention.

DESCRIPTION OF THE PREFERRED EMBODIMENTS

Figure 1:
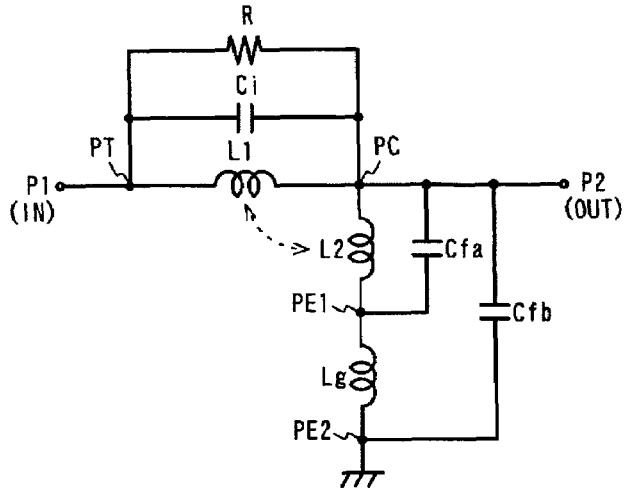
FIG. 1 is a view showing an equivalent circuit of a non-reciprocal circuit device according to one embodiment of the present invention.
Figure 2:
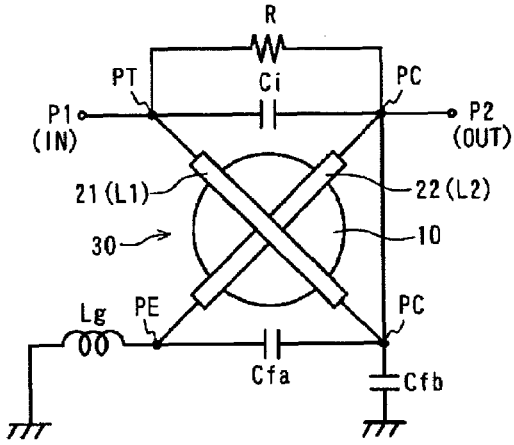
FIG. 2 is a view showing another equivalent circuit of the non-reciprocal circuit device according to one embodiment of the present invention.

FIG. 1 shows the equivalent circuit of a wideband non-reciprocal circuit device according to one embodiment of the present invention. This non-reciprocal circuit device is a two-port isolator having first and second input/output ports P1, P2, which comprises a first inductance element L1 disposed between the first input/output port P1 and the second input/output port P2, a second inductance element L2 disposed between the second input/output port P2 and a ground, a first capacitance element Ci constituting a first resonance circuit with the first inductance element L1, a second capacitance element Cfa constituting a second resonance circuit with the second inductance element L2, a resistance element R parallel-connected to the first resonance circuit, a third inductance element Lg disposed between the second resonance circuit and the ground, and a third capacitance element Cfb disposed between the first resonance circuit on the side of the second input/output port P2 and the ground. In the equivalent circuit schematically shown in FIG. 2, a central conductor 30 constituting the first and second inductance elements L1, L2 comprises first and second central conductors 21, 22 disposed on the ferrimagnetic body 10.

The crux of the present invention is that the non-reciprocal circuit device comprises the third inductance element Lg disposed between the second resonance circuit and the ground, and the third capacitance element Cfb disposed between the second input/output port P2 of the first resonance circuit and the ground.

In the equivalent circuit of a conventional non-reciprocal circuit device, the first resonance circuit disposed between the first and second input/output ports P1, P2 acts as a highpass filter, while the second resonance circuit disposed between the second input/output port P2 and the ground acts as a lowpass filter, resulting in characteristics like a bandpass filter, which has relatively large attenuation outside the passband. Although the non-reciprocal circuit device of the present invention has characteristics as a bandpass filter like the conventional non-reciprocal circuit device, it has wideband transmission characteristics, because the second inductance element L2 is series-connected to the third inductance element Lg, and because the third capacitance element Cfb is parallel-connected to these inductors.

Figure 3:
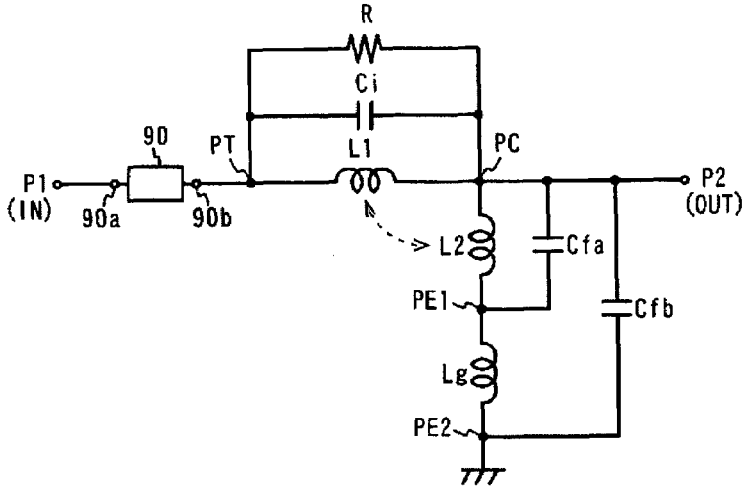
FIG. 3 is a view showing an equivalent circuit of a non-reciprocal circuit device according to another embodiment of the present invention.
Figure 4A:
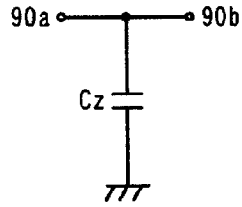
FIG. 4(*a*) is a view showing the equivalent circuit of one example of impedance-adjusting means used in the non-reciprocal circuit device of the present invention.
Figure 4B:
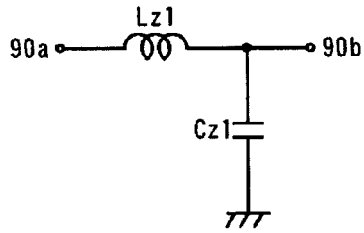
Figure 4C:
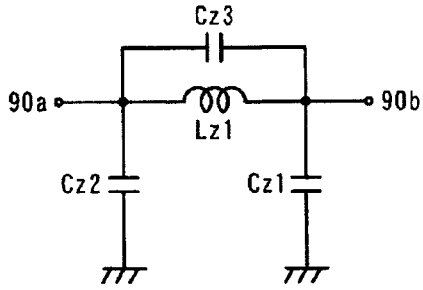
Figure 4D:
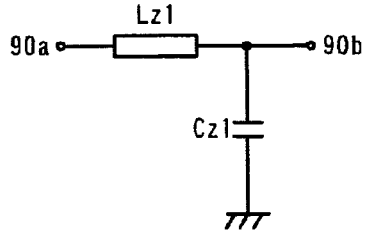
Figure 4E:
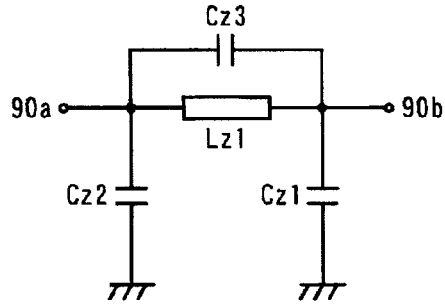
Figure 5A:
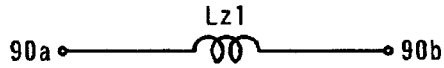
FIG. 5(*a*) is a view showing the equivalent circuit of a still further example of impedance-adjusting means used in the non-reciprocal circuit device of the present invention.
Figure 5B:
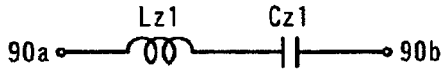
Figure 5C:
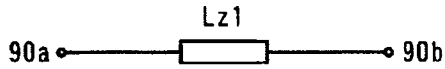
Figure 5D:
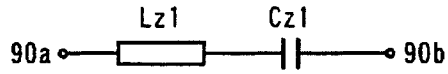
Figure 6A:
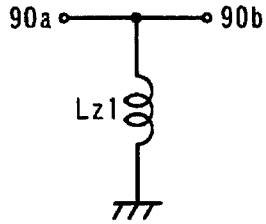
FIG. 6(*a*) is a view showing the equivalent circuit of a still further example of impedance-adjusting means used in the non-reciprocal circuit device of the present invention.
Figure 6B:
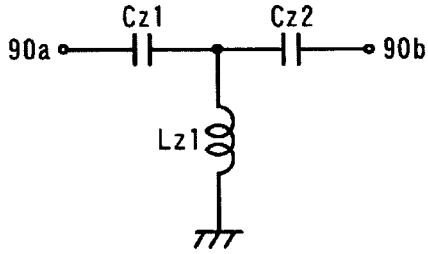
Figure 6C:
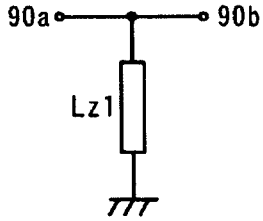
Figure 6D:
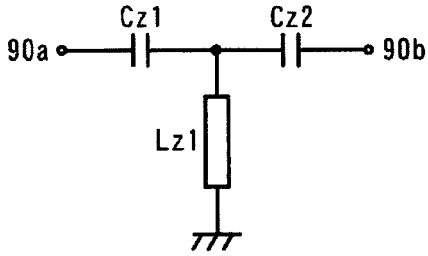

As shown in FIG. 3, the non-reciprocal circuit device of the present invention preferably comprises an impedance-adjusting means 90 between the first input/output port P1 and a port PT. The impedance-adjusting means 90 is preferably constituted by a fourth inductance element and/or a fourth capacitance element, which are properly selected depending on whether the port PT has inductive or capacitive input impedance. Desired impedance adjustment is conducted, for instance, by using an impedance-adjusting means 90 having capacitive input impedance when the input impedance of the non-reciprocal circuit device is inductive when viewed from the port PT, or by using an impedance-adjusting means 90 having inductive input impedance when the input impedance is capacitive.

FIGS. 4-6 show various examples of the impedance-adjusting means 90. Though not restrictive, inductance elements and/or capacitance elements constituting the impedance-adjusting means 90 are preferably easy-to-handle chip devices with easily changeable constants, but they may be constituted by electrode patterns in the multi-layer substrate.

When the impedance-adjusting means 90 is constituted by a lowpass filter, the impedance can be easily adjusted, with a second harmonic attenuated by the attenuation pole obtained by the second capacitance element Cfa and the inductance element L2, and a third harmonic attenuated by the lowpass filter, resulting in excellent attenuation of harmonics.

In a power amplifier to which the non-reciprocal circuit device is connected, a harmonics-controlling circuit such as an open stub and a short-circuiting stub is connected to an output terminal (drain electrode) of a high-frequency power transistor. This harmonics-controlling circuit is open at a fundamental frequency, and short-circuited to harmonics (for instance, a second harmonic) with even multiples of the fundamental frequency. Such structure can erase harmonics generated in the amplifier with waves reflecting from the connecting point of the harmonics-controlling circuit at high efficiency.

With respect to the input impedance characteristics, the non-reciprocal circuit device is substantially short-circuited at a second harmonic in some cases. The power amplifier is likely to perform an unstable operation under such impedance conditions, causing oscillation, etc. Thus, the impedance-adjusting means 90 is utilized as a phase circuit, to shift the phase θ such that the power amplifier and the non-reciprocal circuit device are in non-conjugated matching, thereby suppressing the oscillation of the power amplifier. For instance, when the inductance element of the impedance-adjusting means 90 is a distribution-constant line series-connected between the first input/output port P1 and the port PT, input impedance to the second harmonic can be controlled in a desired range by adjusting the length and shape of the distribution-constant line.

[1] First Embodiment

Figure 7:
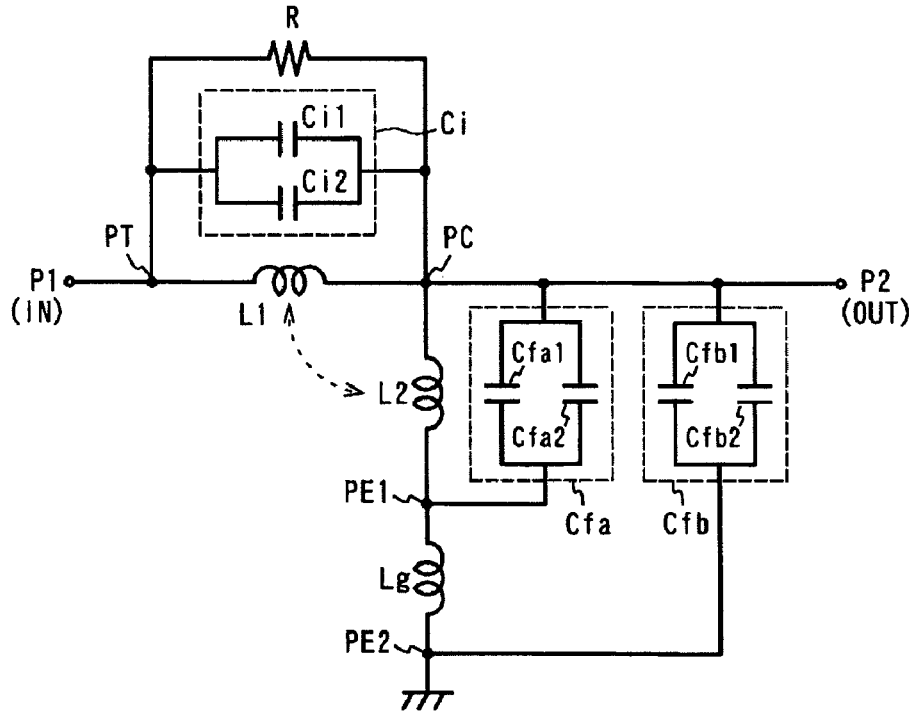
FIG. 7 is a detailed view showing the equivalent circuit of a non-reciprocal circuit device according to one embodiment of the present invention.
Figure 8:
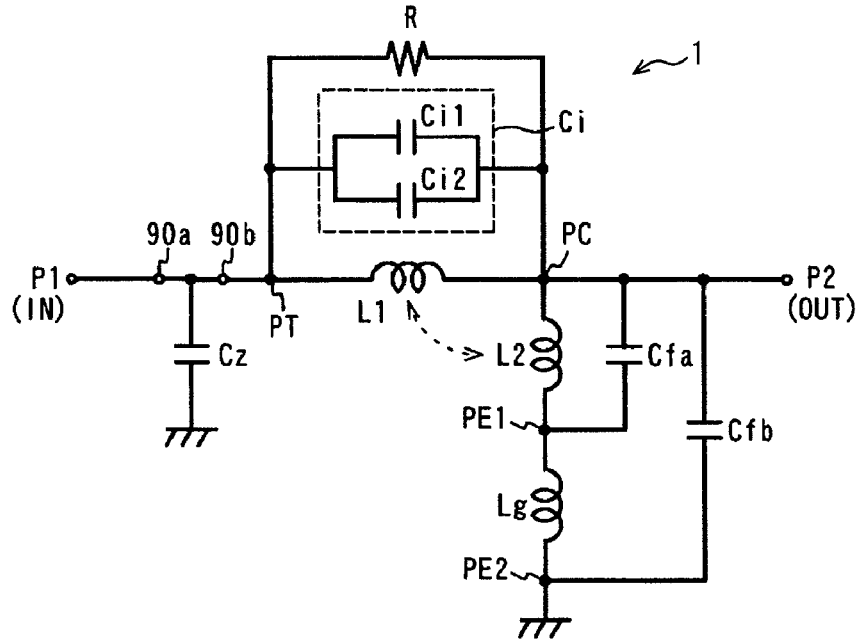
FIG. 8 is a view showing the equivalent circuit of a non-reciprocal circuit device according to the first embodiment of the present invention.

FIG. 8 shows the equivalent circuit of a non-reciprocal circuit device according to the first embodiment of the present invention. In this embodiment, an impedance-adjusting means 90 is a capacitance element Cz shunt-connected between the first input/output port P1 and the first inductance element L1. Because the other part of this equivalent circuit is the same as shown in FIGS. 1 and 7, its explanation will be omitted.

Figure 9:
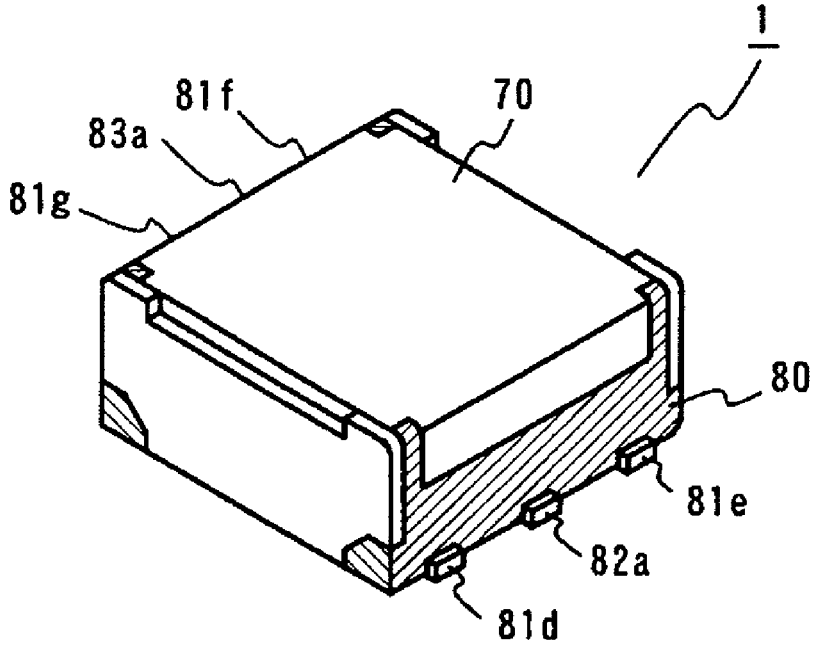
FIG. 9 is a perspective view showing a non-reciprocal circuit device according to the first embodiment of the present invention.
Figure 10:
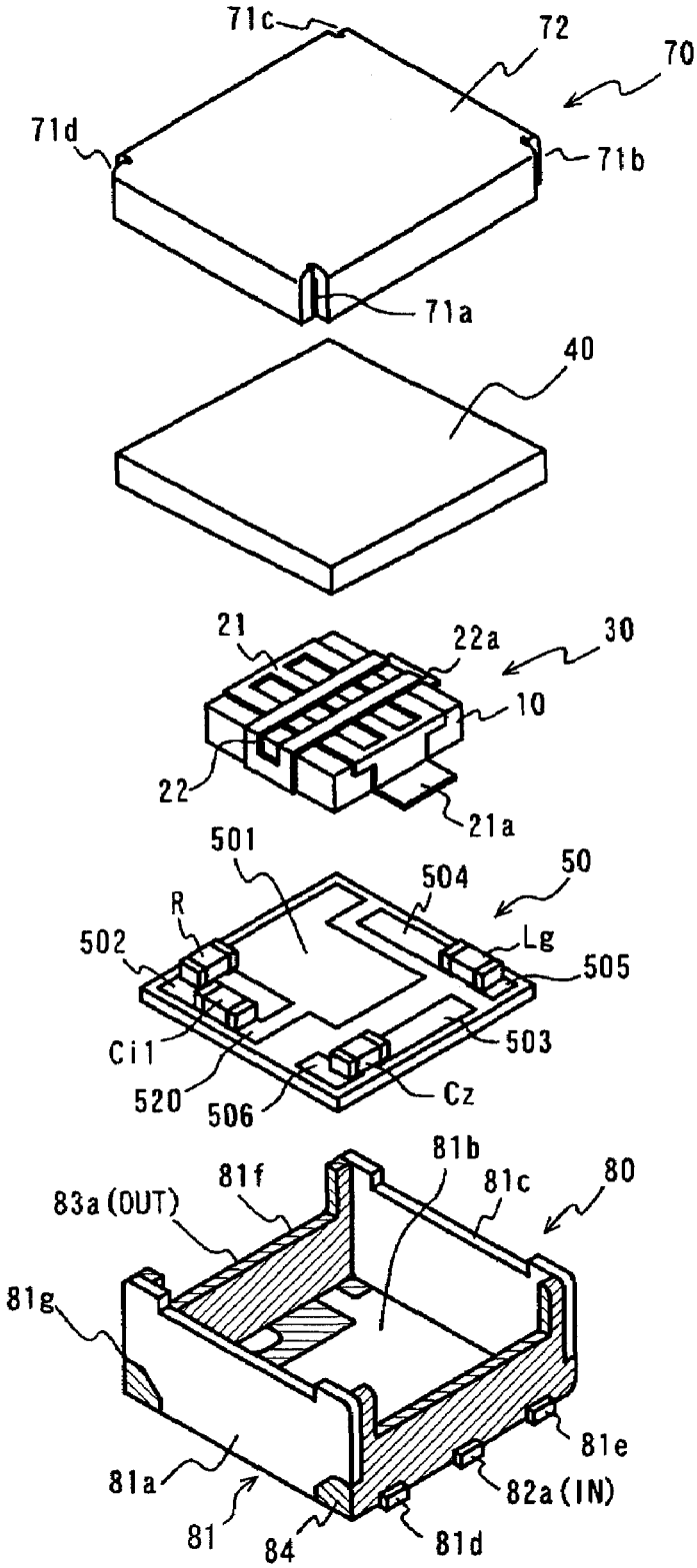
FIG. 10 is an exploded perspective view showing the internal structure of the non-reciprocal circuit device of FIG. 9.

FIG. 9 shows the appearance of the non-reciprocal circuit device 1, and FIG. 10 shows its structure. The non-reciprocal circuit device 1 comprises a central conductor assembly 30 comprising a microwave ferrite 10 and first and second central conductors 21, 22 crossing thereon with electric insulation; a laminate substrate 50 comprising part of a first capacitance element Ci, a second capacitance element Cfa and a third capacitance element Cfb for constituting resonance circuits with the first and second central conductors 21, 22; chip devices mounted on the laminate substrate 50 (a resistance element R, a capacitance element Cz, and a capacitance element Ci1 constituting part of the first capacitance element Ci); a resin case 80 comprising an input terminal 82*a* and an output terminal 83*a* electrically connected to the laminate substrate 50, and metal frame 81; a permanent magnet 40 applying a DC magnetic field to the microwave ferrite 10; and an upper case 70; the permanent magnet 40, the central conductor assembly 30 and the laminate substrate 50 being received in a space defined by the resin case 80 and the upper case 70.

In the central conductor assembly 30, the first central conductor 21 and the second central conductor 22 are crossing via an insulating layer (not shown), for instance, on a rectangular microwave ferrite 10. In this embodiment, the first central conductor 21 is perpendicular to the second central conductor 22 (crossing angle: 90°), but the non-reciprocal circuit device of the present invention is not restricted thereto. The first central conductor 21 and the second central conductor 22 may be crossing at an angle of 80-110°. Because the input impedance of the non-reciprocal circuit device changes depending on the crossing angle, it is preferable to adjust the crossing angle of the first central conductor 21 and the second central conductor 22 together with the impedance-adjusting means 90 for the optimum impedance matching.

Figure 11:
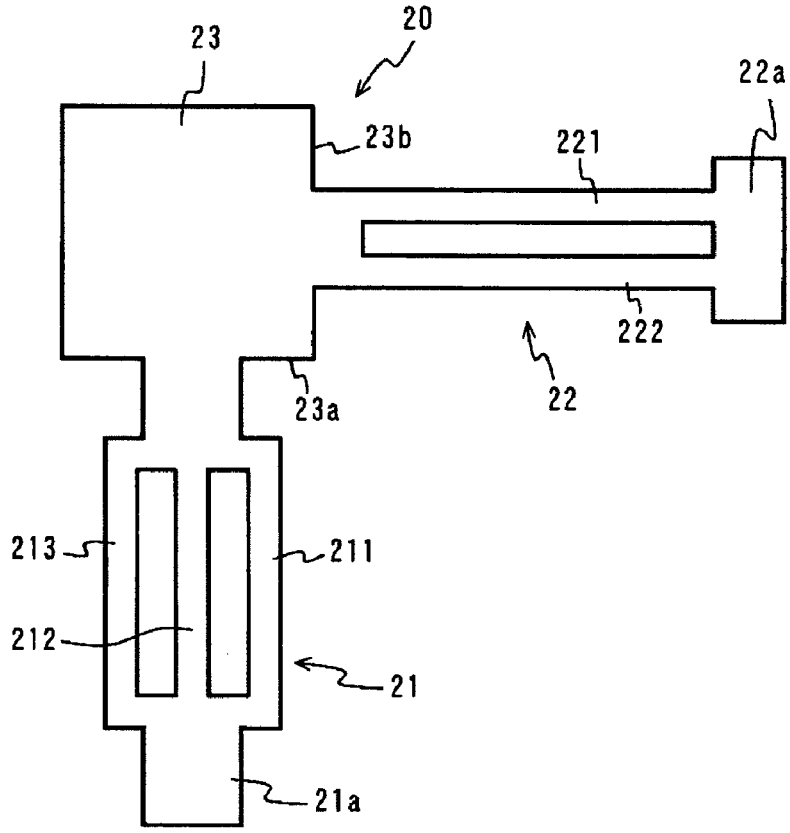
FIG. 11 is a development showing a central conductor used in the non-reciprocal circuit device according to the first embodiment of the present invention.
Figure 12:
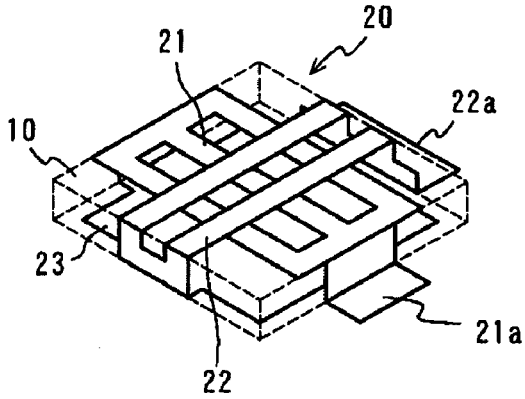
FIG. 12 is a perspective view showing a central conductor assembly used in the non-reciprocal circuit device according to the first embodiment of the present invention.

FIG. 11 shows a central conductor 20 constituting the central conductor assembly 30, and FIG. 12 shows the central conductor 20 assembled on the microwave ferrite 10. It should be noted that the microwave ferrite 10 is shown by a broken line in FIG. 12, such that a common portion 23 of the central conductor 20 can be seen. The central conductor 20 is an L-shaped copper plate having the first and second central conductors 21, 22 integrally extending from the common portion 23 in two directions. This copper plate is preferably as thin as 30 μm, for instance, and provided with semi-gloss silver plating of 1-4 μm. Such central conductor 20 has low loss by a skin effect at high frequencies.

The first central conductor 21 comprises three parallel conductors (lines) 211-213, and the second central conductor 22 comprises two conductors (lines) 221, 222. With such structure, the first central conductor 21 has smaller inductance than that of the second central conductor 22.

The first and second central conductors 21, 22 enclosing the microwave ferrite 10 provides larger inductance than when the central conductor 20 is disposed simply on a main surface of the microwave ferrite 10. Accordingly, the central conductor 20 can be made smaller while securing sufficient inductance, thereby reducing the size of the non-reciprocal circuit device and thus the size of the microwave ferrite 10.

Although the first and second central conductors 21, 22 are constituted by an integral copper plate in this embodiment, they may be formed by separate conductors. Also, the first and second central conductors 21, 22 may be formed by (a) a method of printing or etching conductors on both surfaces of flexible, heat-resistant, insulating sheet of polyimide, etc., (b) a method of directly printing conductors on the microwave ferrite 10 as described in JP 2004-88743 A, (c) an LTCC (low temperature co-fired ceramics) method comprising printing green sheets with a conductive paste of Ag, Cu, etc. to form electrode patterns constituting the first and second central conductors 21, 22, laminating the electrode-printed green sheets with a green sheet for forming the microwave ferrite 10, and integrally sintering them, etc.

Although the microwave ferrite 10 is rectangular in this embodiment, this is not restrictive, but it may be in a disc shape. It should be noted, however, that the rectangular microwave ferrite 10 is advantageous over the disc-shaped microwave ferrite 10, because longer first and second central conductors 21, 22 with larger inductance can be wound around the rectangular microwave ferrite 10.

The microwave ferrite 10 need only be made of a magnetic material having a function as a non-reciprocal circuit device to a DC magnetic field applied from the permanent magnet 40. The microwave ferrite 10 preferably has a garnet structure, for instance, YIG (yttrium-iron-garnet). Part of Y in YIG may be substituted by Gd, Ca, V, etc., and part of Fe may be substituted by Al, Ga, etc. Ni ferrite may also be used depending on the frequency used.

The permanent magnet 40 applying a DC magnetic field to the central conductor assembly 30 is fixed to an inner surface of a substantially box-shaped upper case 70 with an adhesive, etc. The permanent magnet 40 is preferably ferrite magnet ($SrO\text{-}nFe_2O_3$), which is inexpensive and has suitable temperature characteristics for the microwave ferrite 10. Particularly preferable is ferrite magnet having a magnetoplumbite-type crystal structure in which part of Sr and/or Ba is substituted by an R element (at least one of rare earth elements including Y), and part of Fe is substituted by an M element (at least one selected from the group consisting of Co, Mn, Ni and Zn), the R element and/or the M element being added in the form of compounds in a pulverization step after calcining, which has a higher magnetic flux density than that of usual ferrite magnet ($SrO\text{-}nFe_2O_3$), enabling the size and thickness reduction of the non-reciprocal circuit device. The ferrite magnet preferably has a residual magnetic flux density Br of 420 mT or more, and coercivity iHc of 300 kA/m or more. Rare earth magnets such as Sm—Co magnets, Sm—Fe—N magnets and Nd—Fe—B magnets may also be used.

Figure 13:
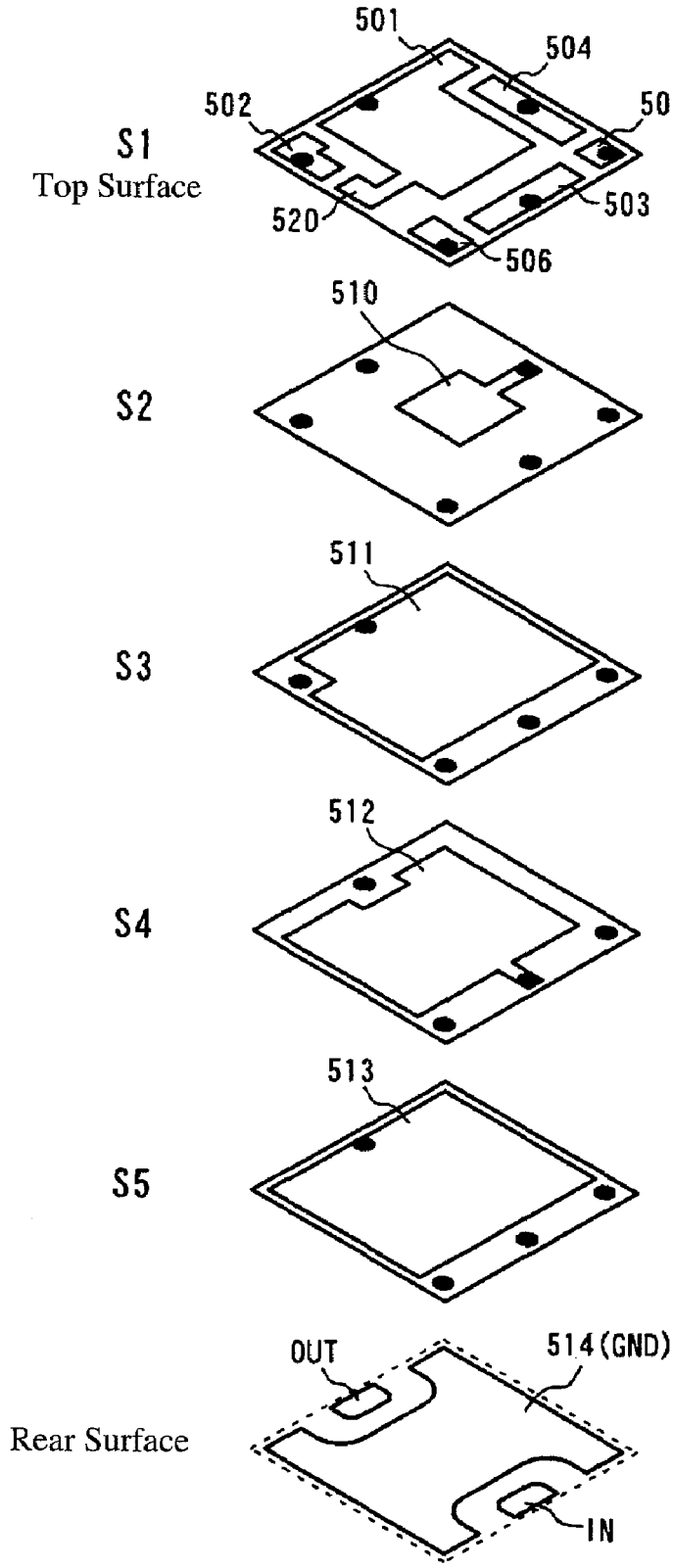
FIG. 13 is an exploded perspective view showing the internal structure of a laminate substrate used in the non-reciprocal circuit device according to the first embodiment of the present invention.

FIG. 13 shows the structure of the laminate substrate 50, which comprises five dielectric sheets S1-S5. Ceramics for the dielectric sheets S1-S5 are preferably low-temperature-cofired ceramics (LTCC), which can be sintered together with a conductive paste of Ag, etc. From the environmental point of view, the low-temperature-cofired ceramics preferably do not contain lead. Such a low-temperature-cofired ceramic preferably has a composition comprising 100% by mass of main components comprising 10-60% by mass (calculated as $Al_2O_3$) of Al, 25-60% by mass (calculated as $SiO_2$) of Si, 7.5-50% by mass (calculated as SrO) of Sr, and more than 0% and 20% or less by mass (calculated as $TiO_2$) of Ti, and sub-components comprising at least one selected from the group consisting of 0.1-10% by mass (calculated as $Bi_2O_3$) of Bi, 0.1-5% by mass (calculated as $Na_2O$) of Na, 0.1-5% by mass (calculated as $K_2O$) of K, and 0.1-5% by mass (calculated as CoO) of Co, and at least one selected from the group consisting of 0.01-5% by mass (calculated as CuO) of Cu, 0.01-5% by mass (calculated as $MnO_2$) of Mn, and 0.01-5% by mass of Ag. When the laminate substrate 50 is made of low-temperature-cofired ceramics having high Q values, high-conductivity metals such as Ag, Cu, Au, etc. can be used for the electrode patterns, providing a non-reciprocal circuit device with extremely low loss.

A ceramic mixture having the above composition is calcined at 700-850° C., pulverized to an average particle size 0.6-2 μm, mixed with a binder such as ethyl cellulose, thermoplastic olefin elastomers and polyvinyl butyral (PVB), a plasticizer such as butylphthalyl butylglycolate (BPBG), and solvent to form slurry, and then formed into a dielectric green sheet by a doctor blade method, etc. With via-holes formed in green sheets, a conductive paste is printed on the green sheets to form electrode patterns, such that the via-holes are filled with the conductive paste. Thereafter, the green sheets are laminated, and sintered to produce a laminate substrate 50.

The electrode patterns on the surface of the multi-layer substrate 50 are preferably plated with Ni and Au successively. The Au plating having high conductivity and good wettability with a solder provides the non-reciprocal circuit device with low loss. The Ni plating improves the bonding strength of the Au plating to the electrode pattern of Ag, Cu, Ag—Pd, etc. The thickness of the electrode pattern including the plating is usually about 5-20 μm, 2 times or more the thickness from which a skin effect appears.

Because the laminate substrate 50 is as small as about 3 mm×3 mm or less, it is preferable to produce a mother laminate substrate comprising pluralities of laminate substrates 50 connected to each other via dividing grooves, breaking the mother laminate substrate along the dividing grooves to separate the laminate substrates 50. Of course, the mother laminate substrate without dividing grooves may be cut by a dicer or a laser.

The laminate substrate 50 with small sintering strain can be formed by sandwiching it by shrinkage-suppressing sheets that are not sintered under the sintering conditions of the laminate substrate 50 (particularly at a sintering temperature of 1000° C. or lower), sintering them while suppressing sintering shrinkage in a plane direction (X-Y direction), and removing the shrinkage-suppressing sheets by ultrasonic washing, wet horning, blasting, etc. In this case, the laminate substrate 50 is preferably pressed in a Z direction during sintering. The shrinkage-suppressing sheet is formed by alumina powder, or a mixture of alumina powder and stabilized zirconia powder, etc.

Each dielectric sheet S1-S5 is printed with a conductive paste to form electrode patterns. The dielectric sheet S1 is provided with electrode patterns 501-506, 520, the dielectric sheet S2 is provided with an electrode pattern 510, the dielectric sheet S3 is provided with an electrode pattern 511, the dielectric sheet S4 is provided with an electrode pattern 512, and the dielectric sheet S5 is provided with an electrode pattern 513. The electrode patterns on the dielectric sheet S1-S5 are electrically connected through via-holes (shown by black circles in the figure) filled with the conductive paste. The via-holes connect the electrode patterns 505, 506 to a ground electrode 514 on the rear surface, the electrode pattern 504 to the electrode pattern 510, the electrode pattern 503 to the input terminal IN, the electrode pattern 502 to the electrode pattern 512, and the electrode patterns 501, 511, 513 to the output terminal OUT. Thus, the electrode patterns 501, 511 and the electrode pattern 510 constitute the second capacitance element Cfa, the electrode patterns 511, 513 and the electrode pattern 512 constitute a capacitor Ci2, part of the first capacitance element Ci, and the electrode pattern 513 and the ground electrode 514 constitute the third capacitance element Cfb.

Because electrode patterns constituting the first and second capacitance element Ci, Cfa are formed on pluralities of layers, and parallel-connected through via-holes in this embodiment, the laminate substrate 50 has the maximum area ratio of electrode patterns per one layer, resulting in large capacitance.

Pluralities of electrode patterns on the dielectric sheet S1 appear on the main surface of the laminate substrate 50. A chip capacitor Cz acting as the impedance-adjusting means 90 is soldered between the electrode patterns 503, 506, a chip resistor R is soldered between the electrode patterns 501, 502, a chip capacitor Ci1 constituting the first capacitance element Ci is soldered between the electrode patterns 502, 520, and a chip inductor Lg constituting the third inductance element is soldered between the electrode patterns 504, 505. A common portion 23 of the central conductor 20 is connected to the electrode pattern 501 by soldering, etc., an end portion 21*a* of the first central conductor 21 is connected to the electrode pattern 503 by soldering, etc., and an end portion 22*a* of the second central conductor 22 is connected to the electrode pattern 504 by soldering, etc.

The input and output electrodes IN, OUT are disposed on a rear surface of the laminate substrate 50 with the ground electrode 514 therebetween. The ground electrode 514 is electrically connected by soldering, etc. to a bottom 81*b* of the metal frame 81 insert-molded in the resin case 80 at the bottom. The input electrode IN is electrically connected to a part 82*b* of the input terminal appearing on an inner surface of the resin case 80, and the output electrode OUT is electrically connected to a part 83*b* of the output terminal appearing on an inner surface of the resin case 80, both by soldering, etc.

Because the capacitance element Cz constituting the impedance-adjusting means 90 is a chip capacitor mounted on a main surface of the laminate substrate 50 in this embodiment, the input impedance can be easily adjusted by selecting the chip capacitor. The capacitance element Cz for the impedance-adjusting means 90 may be formed by electrode patterns in the laminate substrate 50, or by a combination of the mounted chip capacitor and the capacitance element in the laminate substrate. With such structure, the capacitance of the impedance-adjusting means in the laminate substrate 50 can be adjusted by the chip capacitor.

The impedance-adjusting means may be constituted by an inductance element, or a combination of an inductance element and a capacitance element. The inductance element may be a chip inductor or an electrode pattern (line pattern) formed by a conductive paste printed on a dielectric sheet. When the inductance element and the capacitance element used as the impedance-adjusting means are formed by electrode patterns, their capacitance and inductance are adjusted by trimming. On the other hand, when a chip capacitor and a chip inductor are used, their capacitance and inductance can be finely set to provide good impedance matching freely.

The third capacitance element Cfb is formed in the laminate substrate 50 by electrode patterns, but it may be a chip capacitor mounted on a main surface of the laminate substrate 50, or a combination of a chip capacitor and in capacitance elements the laminate substrate, like the other capacitance elements. When the chip capacitor is used, the capacitance can be easily adjusted.

A substantially box-shaped upper case 70 containing the constituent devices is made of a ferromagnetic metal such as soft iron for constituting a magnetic circuit, like the frame 81, and plated with Ag, Cu, etc. The upper case 70 connected to the sidewalls 81*a*, 81*c* of the metal frame 81 insert-molded in the resin case 80 acts as a magnetic yoke for a magnetic path enclosing the permanent magnet 40, the central conductor assembly 30 and the laminate substrate 50.

The upper case 70 is preferably provided with high-conductivity plating of Ag, Cu, Au, Al or these alloys. The plating has a thickness of 0.5-25 μm, preferably 0.5-10 μm, more preferably 1-8 μm, and electric resistivity of 5.5 μΩ·cm or less, preferably 3.0 μΩ·cm or less, more preferably 1.8 μΩ·cm or less. Such high-conductivity plating suppresses interference with external circuits, thereby reducing loss.

Figure 14:
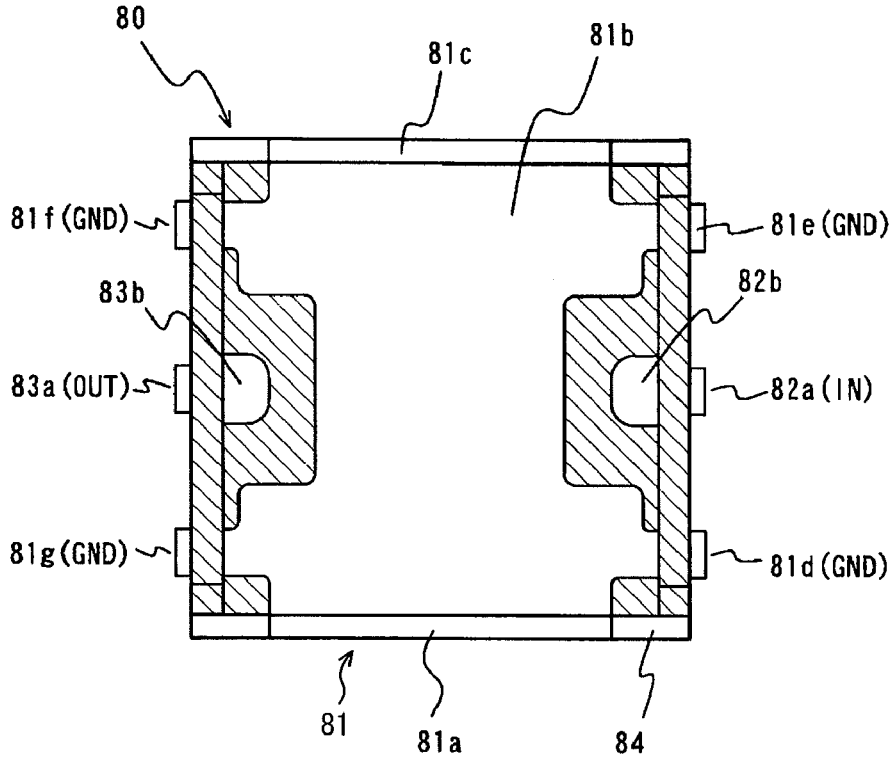
FIG. 14 is a plan view showing a resin case used in the non-reciprocal circuit device according to the first embodiment of the present invention.

FIG. 14 shows the resin case 80. Insert-molded in the resin case 80 are an input terminal 82*a* (IN) (first input/output port P1 in the equivalent circuit), an output terminal 83*a* (OUT) (second input/output port P2 in the equivalent circuit), and a frame 81, which are formed by a thin, conductive plate of about 0.1 mm. In this embodiment, the frame 81, the input terminal 82*a* (IN) and the output terminal 83*a* (OUT) are formed from a metal plate by punching, etching, etc. The frame 81 integrally comprises a bottom 81*b*, two sidewalls 81*a*, 81*c* vertically extending from both ends of the bottom 81*b*. The terminals 81*d*-81*g* are integral with the frame 81, used as ground terminals. The metal plate is, for instance, SPCC having a thickness of about 0.15 mm, which has Cu plating having a thickness of 1-3 μm and Ag plating having a thickness of 2-4 μm. The plating improves high-frequency characteristics.

The frame bottom 81*b* is electrically insulated from the input and output terminals IN, OUT, such that it acts as a ground. Accordingly, the bottom 81*b* is separate from a part 82*b* of the input terminal IN and a part 83*b* of the output terminal OUT by about 0.3 mm. When the sidewalls 81*a*, 81*c* of the frame engage the sidewalls of the upper case 70, a magnetic flux generated from the permanent magnet 70 is uniformly applied to the central conductor assembly 30.

With the laminate substrate 50 received in the resin case 80, electric connection is made between the input terminal IN of the laminate substrate 50 and a part of 82*b* of the input terminal in the resin case 80, and between the output terminal OUT of the laminate substrate 50 and a part of 83*b* of the output terminal in the resin case 80 by soldering. A ground GND at the bottom of the laminate substrate 50 is electrically connected to the frame bottom 81*b* of the resin case 80 by soldering.

The resin case 80 shown in FIG. 14 has four ground terminals GND to secure a ground potential stably. With six positions including the input and output terminals IN, OUT soldered, the non-reciprocal circuit device has high mounting strength.

It is preferable that only one of the sidewalls 81*a*, 81*c* of the frame 81 in the resin case 80 is soldered to the upper case 70, with the other bonded by an adhesive, or that both sidewalls 81*a*, 81*c* are bonded to the upper case 70 by an adhesive. When both sidewalls 81*a*, 81*c* of the frame 81 are soldered to the upper case 70, a high-frequency magnetic field generated from a high-frequency current loop in the upper case 70 is likely to affect the central conductor assembly 30, deteriorating insertion loss.

Example 1, Comparative Example 1

A ceramic mixture having a composition comprising 100% by mass of main components comprising 50% by mass (calculated as $Al_2O_3$) of Al, 36% by mass (calculated as $SiO_2$) of Si, 10% by mass (calculated as SrO) of Sr, and 4% by mass (calculated as $TiO_2$) of Ti, and sub-components comprising 2.5% by mass (calculated as $Bi_2O_3$) of Bi, 2.0% by mass (calculated as $Na_2O$) of Na, 0.5% by mass (calculated as $K_2O$) of K, and 0.3% by mass (calculated as CuO) of Cu was calcined at 800° C., pulverized to an average particle size of 1.2 μm, mixed with a polyvinyl butyral (PVB) binder, a butylphthalyl butylglycolate (BPBG) plasticizer and water to form slurry, and formed into a dielectric green sheet of 30 μm in thickness by a doctor blade method, etc. Each green sheet was provided with via-holes, printed with a conductive Ag paste comprising 75% by mass of Ag powder having an average particle size of 2 μm and 25% by mass of ethyl cellulose to form an electrode pattern. The via-holes were simultaneously filled with the conductive paste. Thereafter, the green sheets were laminated and sintered to produce a laminate substrate 50.

Using the above laminate substrate 50, a non-reciprocal circuit device of 3.2 mm×3.2 mm×1.6 mm (Example 1) for a frequency of 824-915 MHz, which was shown in FIGS. 8-14, was produced. The size of the device used in this non-reciprocal circuit device is shown below. The circuit constants, etc. of this non-reciprocal circuit device are shown in Table 1.

Microwave ferrite 10: Garnet of 1.9 mm×1.9 mm×0.35 mm.

Permanent magnet 40: Rectangular, permanent La—Co ferrite magnet of 2.8 mm×2.5 mm×0.4 mm.

Central conductor 20: 30-μm-thick, L-shaped copper plate shown in FIG. 11, which was formed by etching and provided with semi-gloss Ag plating of 1-4 μm in thickness.

TABLE 1

| Element | Example 1 |
|---|---|
| Impedance-adjusting means Cz | 1-pF chip capacitor |
| First capacitance element Ci | Ci1: 1-pF chip capacitor<br>Ci2: 26-pF capacitor in laminate substrate |
| Second capacitance element Cfa | 9 pF |
| Second capacitance element Cfb | 6.5 pF |
| Third inductance element Lg | 2.5 nH |
| First central conductor | Having 0.18-mm-wide lines with 0.18-mm gap therebetween |
| Second central conductor | Having 0.2-mm-wide lines with 0.2-mm gap therebetween |
| Resistor R | 75 Ω |

Figure 27:
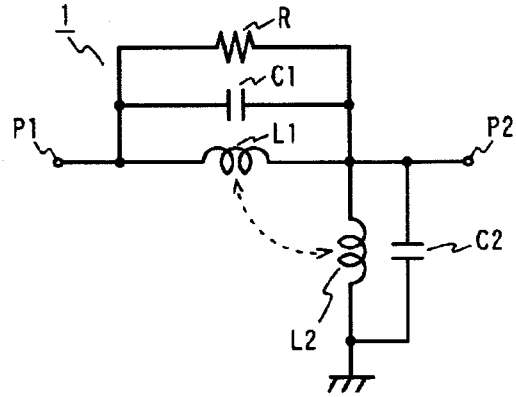
FIG. 27 is a view showing the equivalent circuit of another conventional non-reciprocal circuit device.
Figure 28:
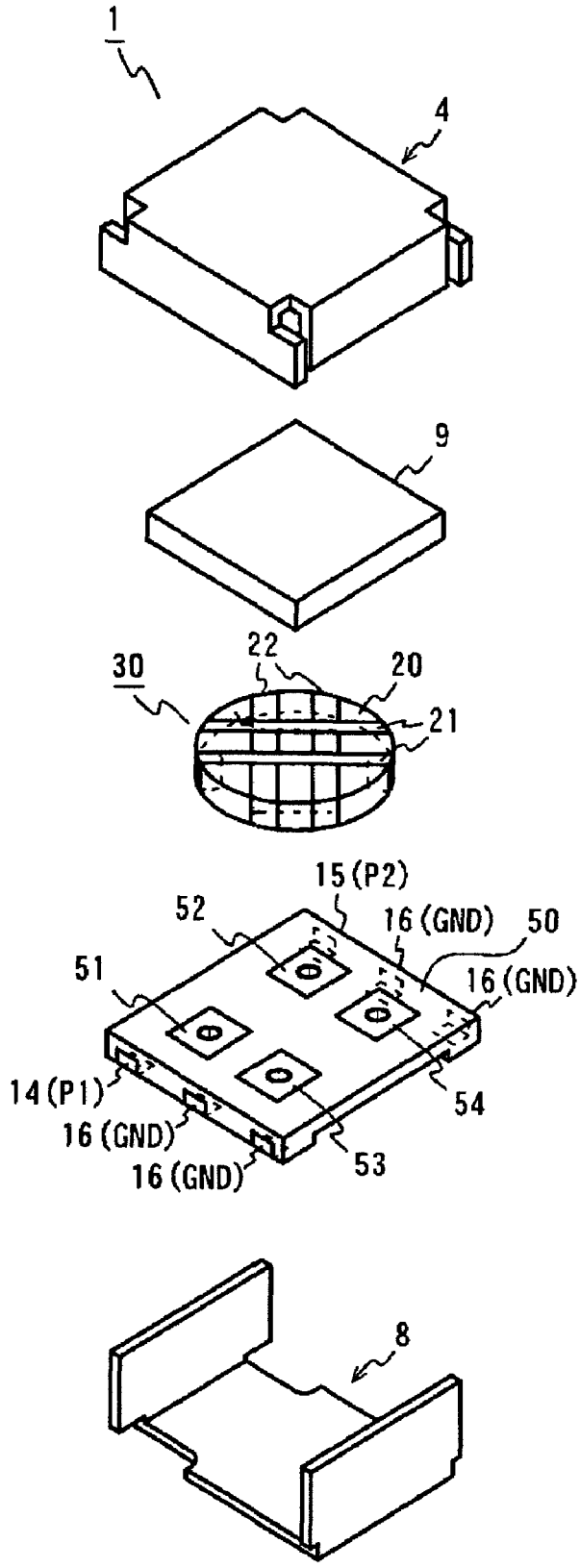
FIG. 28 is an exploded perspective view showing the internal structure of a conventional non-reciprocal circuit device.
Figure 29:
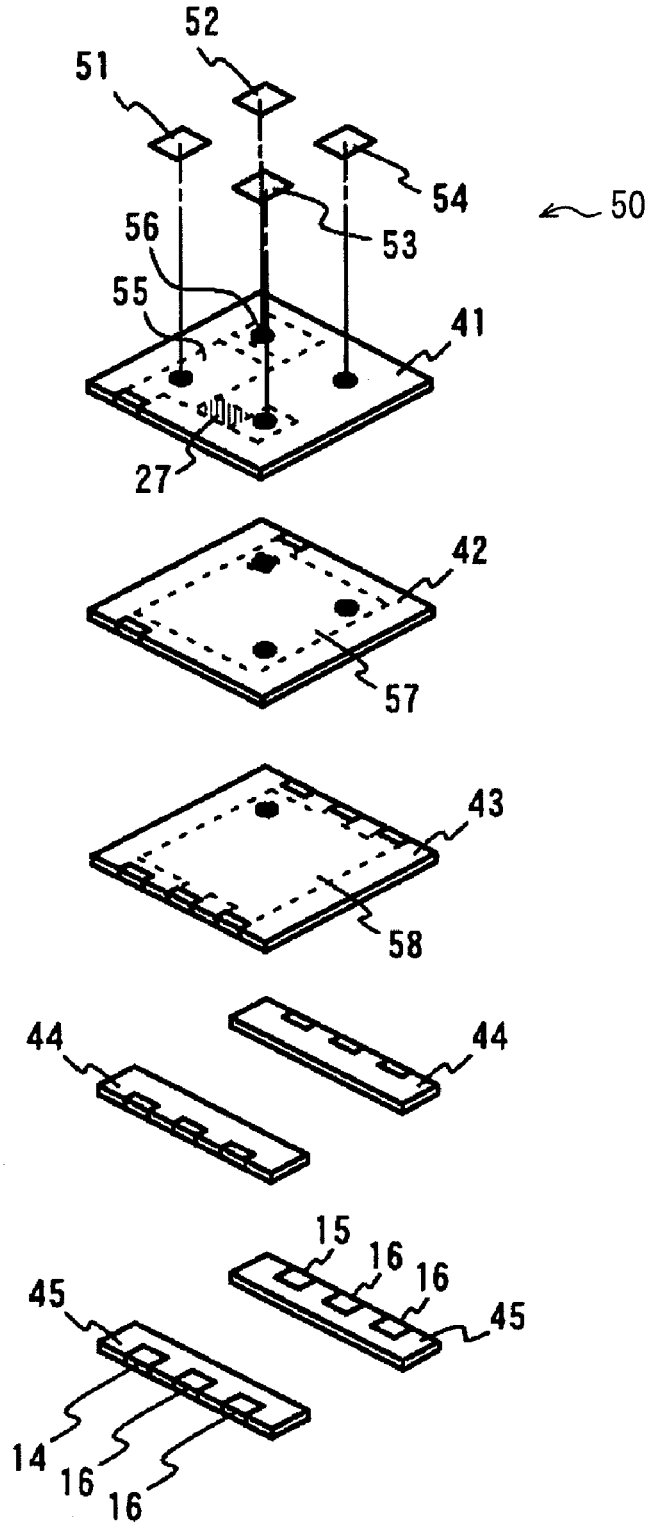
FIG. 29 is an exploded perspective view showing the internal structure of a laminate substrate used in a conventional non-reciprocal circuit device.

Also produced was a non-reciprocal circuit device of Comparative Example 1 having the equivalent circuit shown in FIG. 27 and comprising a capacitance element Cz shunt-connected as an impedance-adjusting means 90. This non-reciprocal circuit device comprised a laminate substrate not having the electrode patterns 512, 513 of Example 1 but having one electrode pattern formed on a dielectric sheet S1. A first capacitance element C1 (corresponding to Ci) was formed by only a chip capacitor, and a second capacitance element Cfa and a third inductance element Lg were not provided. The other part was the same as in Example 1. The circuit constants, etc. of this non-reciprocal circuit device are shown in Table 2.

TABLE 2

| Element | Comparative Example 1 |
|---|---|
| Impedance-adjusting means Cz | 1-pF chip capacitor |
| Capacitance element C1 | 27-pF chip capacitor |
| Capacitance element C2 | 6.5 pF |
| First central conductor | Having 0.18-mm-wide lines with 0.18-mm gap therebetween |
| Second central conductor | Having 0.2-mm-wide lines with 0.2-mm gap therebetween |
| Resistor R | 75 Ω |

The off-band attenuation characteristics, input-side reflection loss, output-side reflection loss, insertion loss and isolation of the non-reciprocal circuit devices of Example 1 and Comparative Example 1 were measured by a network analyzer.

Figure 15:
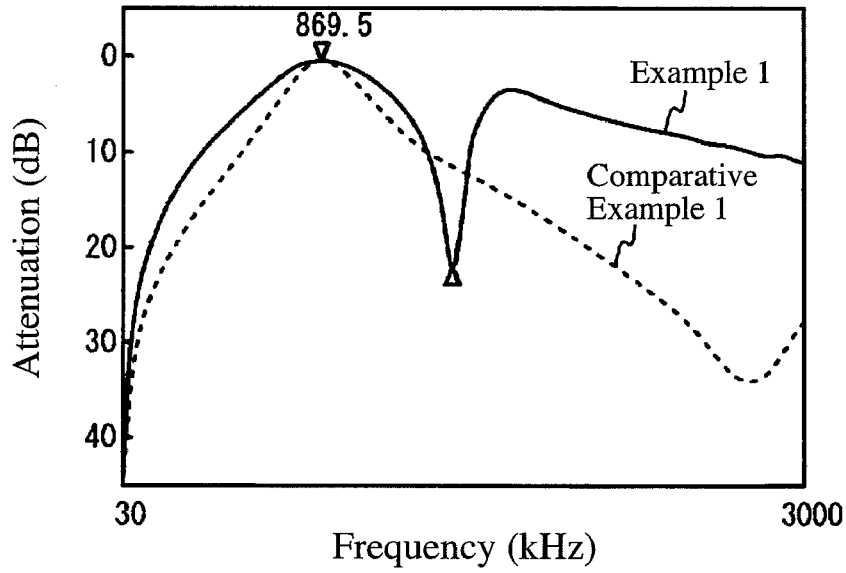
FIG. 15 is a graph showing the off-band attenuation characteristics of the non-reciprocal circuit device of Example 1 and Comparative Example 1.
Figure 16:
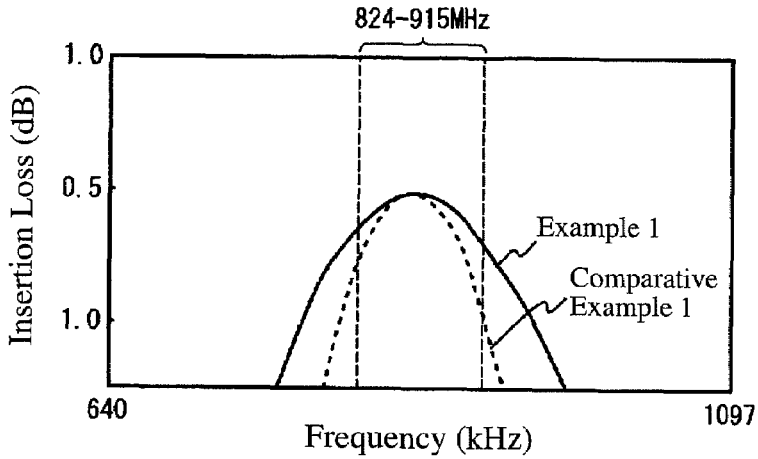
FIG. 16 is a graph showing the insertion loss characteristics of the non-reciprocal circuit devices of Example 1 and Comparative Example 1.
Figure 17:
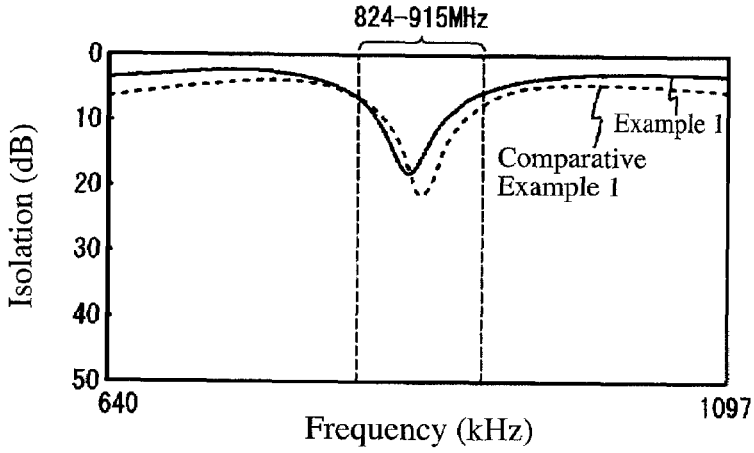
FIG. 17 is a graph showing the isolation characteristics of the non-reciprocal circuit devices of Example 1 and Comparative Example 1.
Figure 18:
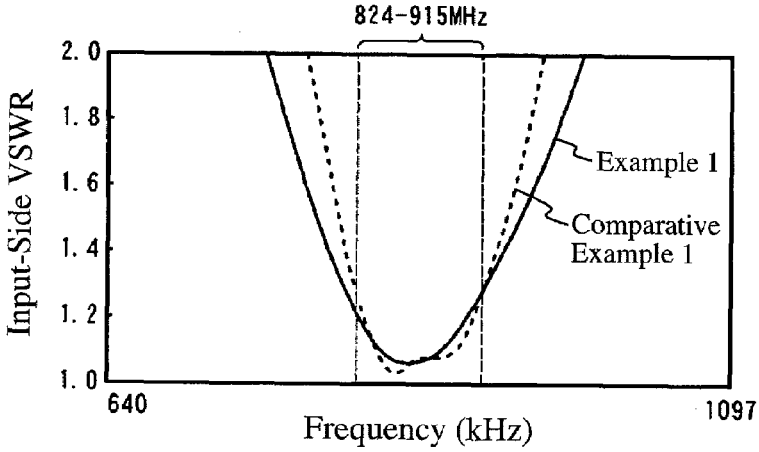
FIG. 18 is a graph showing the input-side VSWR characteristics of the non-reciprocal circuit devices of Example 1 and Comparative Example 1.
Figure 19:
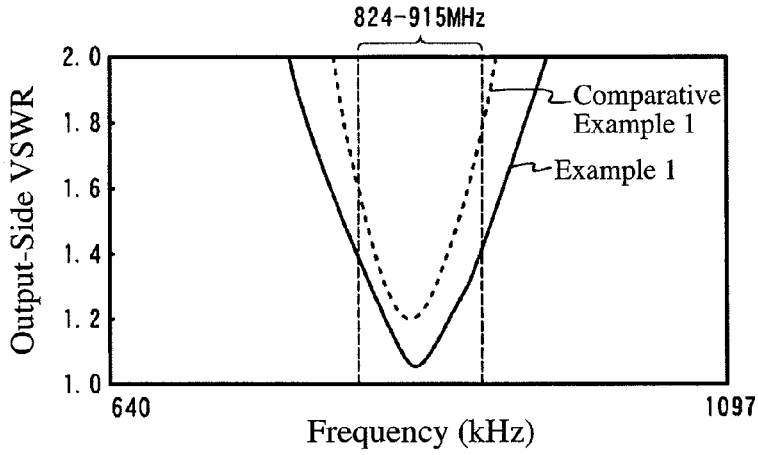
FIG. 19 is a graph showing the output-side VSWR characteristics of the non-reciprocal circuit devices of Example 1 and Comparative Example 1.

FIG. 15 shows the off-band attenuation characteristics, FIG. 16 shows the insertion loss characteristics, FIG. 17 shows the isolation characteristics, FIG. 18 shows the frequency characteristics of a voltage standing wave ratio (VSWR) at the first input/output port P1, and FIG. 19 shows the frequency characteristics of VSWR at the second input/output port P2. Table 3 shows the measured characteristics. The non-reciprocal circuit device of Example 1 was comparable to that of Comparative Example 1 in VSWR (at P1) and isolation characteristics, but much improved than the latter in insertion loss and VSWR (at P2).

TABLE 3

| Characteristics | Frequency (MHz) | Example 1 | Comparative Example 1 |
|---|---|---|---|
| Insertion loss | 824 | 0.51 dB | 0.61 dB |
| | 869.5 | 0.41 dB | 0.41 dB |
| | 915 | 0.57 dB | 0.78 dB |
| Isolation | 824 | 6.5 dB | 6.1 dB |
| | 869.5 | 16.0 dB | 20.7 dB |
| | 915 | 6.0 dB | 7.7 dB |
| VSWR IN | 824 | 1.2 | 1.3 |
| | 869.5 | 1.1 | 1.1 |
| | 915 | 1.3 | 1.3 |
| VSWR OUT | 824 | 1.4 | 1.6 |
| | 869.5 | 1.1 | 1.2 |
| | 915 | 1.4 | 1.8 |

As shown in FIG. 15, the non-reciprocal circuit device of Example 1 had an attenuation pole (shown by a triangle in the figure) at about 1.5 GHz. The evaluation of off-band attenuation characteristics with the second capacitance element Cfa of 4-18 pF and the other circuit constants shown in Table 1 revealed that the attenuation pole changed toward a lower frequency at about 50 MHz/pF as the capacitance increased, resulting in improvement in the isolation characteristics. The insertion loss and its peak frequency did not substantially change. When the second capacitance element Cfa exceeded 18 pF, the attenuation pole neared a passband, resulting in the deterioration of insertion loss characteristics at a peak frequency. With the second capacitance element Cfa of 5 pF and the attenuation-pole-generating frequency of about 1.72 GHz (about two times the pass frequency), harmonics were selectively attenuated.

[2] Second Embodiment

Figure 20:
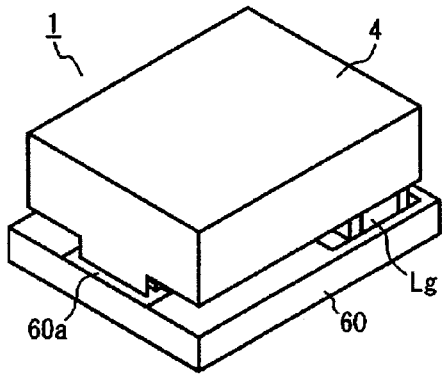
FIG. 20 is a perspective view showing a non-reciprocal circuit device according to the second embodiment of the present invention.
Figure 21:
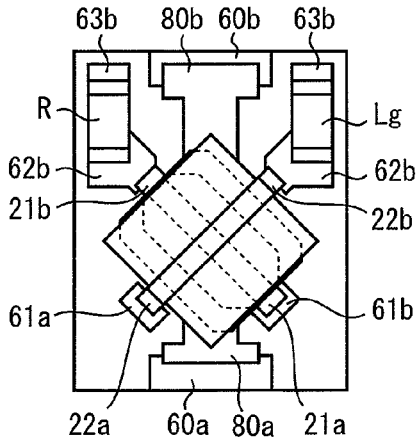
FIG. 21 is a plan view showing the internal structure of non-reciprocal circuit device according to the second embodiment of the present invention.
Figure 22:
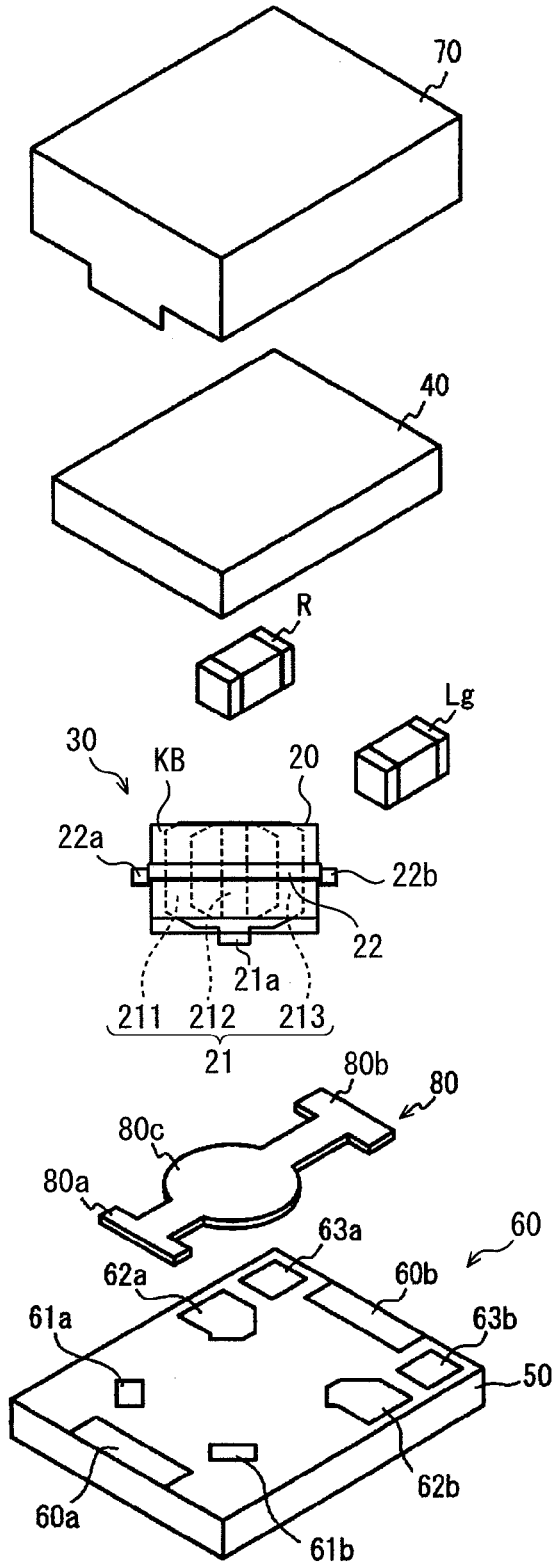
FIG. 22 is an exploded perspective view showing the internal structure of non-reciprocal circuit device according to the second embodiment of the present invention.

FIG. 20 shows the appearance of the non-reciprocal circuit device 1 according to the second embodiment of the present invention, and FIGS. 21 and 22 show its internal structure.

Because the equivalent circuit in this embodiment is the same as in the first embodiment, its explanation will be omitted. The explanation of the same portions as in the first embodiment will also be omitted. Accordingly, the explanation of the first embodiment is applicable to this embodiment unless otherwise mentioned.

The non-reciprocal circuit device 1 comprises a central conductor assembly 30 comprising a ferrimagnetic microwave ferrite 20 and first and second central conductors 21, 22 disposed thereon with electric insulation, a laminate substrate 60 comprising first to third capacitance elements Ci, Cfa and Cfb which constitute a resonance circuit with the first and second central conductors 21, 22, upper and lower yokes 70, 80 constituting a magnetic circuit, and a permanent magnet 40 applying a DC magnetic field to the microwave ferrite 20.

Figure 24A:
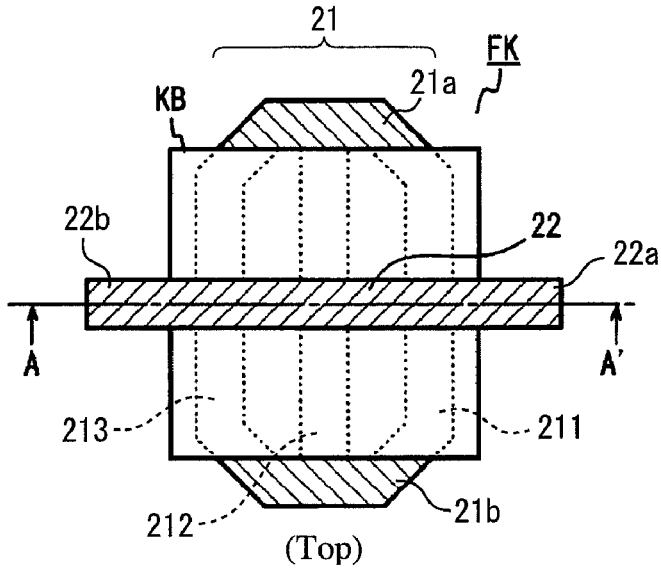
FIG. 24(*a*) is a top plan view showing a central conductor used in the non-reciprocal circuit device according to the second embodiment of the present invention.
Figure 24B:
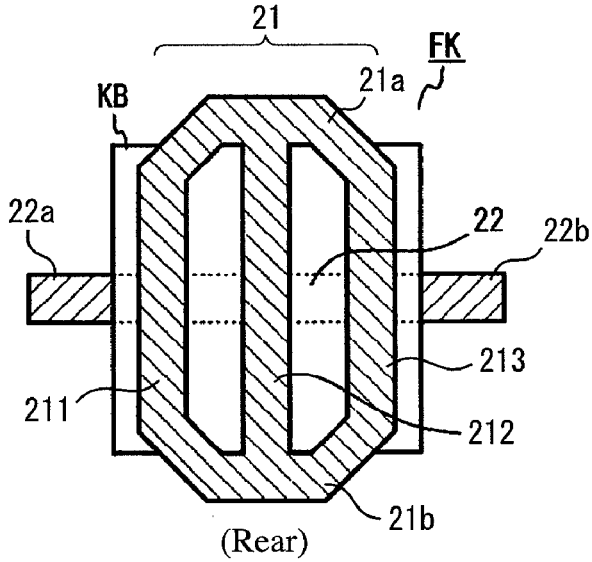
Figure 25:
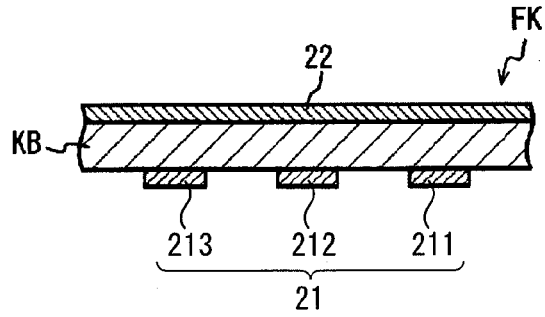
FIG. 25 is a cross-sectional view showing the central conductor of FIG. 24.
Figure 26:
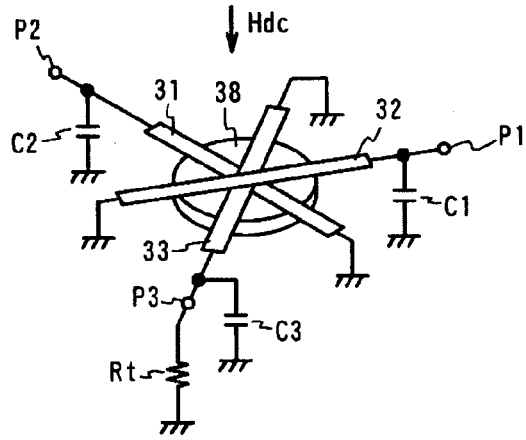
FIG. 26 is a view showing the equivalent circuit of a conventional non-reciprocal circuit device.

The central conductor assembly 30 is constituted, for instance, by the first and second central conductors 21, 22 crossing via an insulating layer (insulating substrate) KB on the rectangular microwave ferrite 20. The first and second central conductors 21, 22 may be constituted by a flexible circuit board FK. FIG. 24(*a*) shows an upper surface of the flexible circuit board FK, FIG. 24(*b*) shows its rear surface, and FIG. 25 shows its cross section. The first and second central conductors 21, 22 are constituted by patterned conductor strips (thin metal foils) crossing at an angle of 90° via the insulating substrate KB. The first central conductor 21 comprises three parallel lines 211, 212, 213 connected at end portions 21*a*, 21*b*, and the second central conductor 22 comprises one line having both end portions 22*a*, 22*b*. Accordingly, the first central conductor 21 has smaller inductance than that of the second central conductor 22. The end portions 21*a*, 21*b*, 22*a*, 22*b* of the central conductors 21, 22 extend from the edge of the insulating substrate KB.

A thin metal foil forming a patterned conductor strip is a copper foil, an aluminum foil, a silver foil, etc. Among them, the copper foil is preferable. The copper foil has good bendability and low resistivity, thereby providing a two-port isolator with small loss.

The patterned conductor strips are preferably as thick as 10-50 μm. When the patterned conductor strips are thinner than 10 μm, they may be broken when the flexible circuit board FK is bent. The patterned conductor strips thicker than 50 μm provide too thick a flexible circuit board FK with low bendability. The patterned conductor strips preferably have width and gap both 100-300 μm, though changeable depending on the targeted inductance. The patterned conductor strips may have the same or partially different gaps.

The insulating substrate KB is preferably a flexible, insulating membrane such as a resin film. The resin film is preferably made of polyimides, polyetherimides, polyamideimides, polyamides such as nylon, polyesters such as polyethylene terephthalate, etc. Among them, polyamides and polyimides are preferable from the aspect of heat resistance and dielectric loss.

The thickness of the insulating substrate KB is preferably 10-50 μm, though not restrictive. When the insulating substrate KB is thinner than 10 μm, the insulating substrate KB has insufficient bending resistance. When the insulating substrate KB is thicker than 50 μm, the first and second central conductors 21, 22 have small coupling, and the flexible circuit board is too thick.

The flexible circuit board FK can be produced with high precision by photolithography. Specifically, metal foils on both surfaces of the insulating substrate KB are coated with a photoresist, exposed to patterning light to remove photoresist layers in regions in which the first and second central conductors 21, 22 are not formed, and chemically etched to remove the metal foils, thereby forming the patterned conductor strips. After the remaining photoresist layers are removed, unnecessary portions of the insulating substrate KB are removed by laser or chemical etching (polyimide etching), such that the end portions 21*a*, 21*b*, 22*a*, 22*b* of the first and second central conductors 21, 22 extend from the edge of the insulating substrate KB. A discoloration-preventing treatment and electric plating of Ni, Au, Ag, etc. are then conducted on the patterned conductor strips, if necessary, to improve corrosion resistance, solderability, electric characteristics, etc.

Unevenness in the crossing angle of the first and second central conductors 21, 22 leads to unevenness in the input/output impedance of a two-port isolator. However, because the first and second central conductors 21, 22 constituted by the flexible circuit board FK have high precision, there is no unevenness in their crossing angle.

The flexible circuit board FK preferably has an adhesive layer SK on the side of the microwave ferrite 20. The adhesive layer SK attaches the flexible circuit board FK to the microwave ferrite 20. The adhesive layer SK may be made of a thermosetting or thermoplastic resin. The adhesive layer SK may be integrally formed on the flexible circuit board FK, for instance, by placing a coverlay film having the adhesive layer SK on a rear surface of the flexible circuit board FK [shown in FIG. 24(*b*)] with the adhesive layer SK below, placing a coverlay film having no adhesive layer on an upper surface of the flexible circuit board FK [shown in FIG. 24(*a*)], and pressing them at a temperature of about 100-180° C. and a pressure of about 1-5 MPa for about 1 hour. The adhesive layer SK is formed on the entire surface of the first central conductor 21, part of the rear surface of the insulating substrate KB which is not covered with the first central conductor 21, and the entire surface of the end portions of the second central conductor 22. The coverlays are removed when the flexible circuit board FK is attached to the ferrite plate 5. Alternatively, the central conductor assembly 30 may be produced by applying an adhesive to the microwave ferrite 20, and then attaching the flexible circuit board to the microwave ferrite 20.

The flexible circuit board FK used in the non-reciprocal circuit device of 2.5 mm×2.5 mm has such a size that is received in a region of 2 mm×2 mm in a plan view. Because it is not practical to form such small flexible circuit boards FK one by one, pluralities of flexible circuit boards are formed in connection to a frame. Because a peripheral portion of the insulating substrate KB is removed to have the end portions of the central conductors extend, the connection the frame is made in the end portions of the patterned conductor strips. Accordingly, pluralities of flexible circuit boards FK connected to a frame are formed, and the patterned conductor strips are cut off from the frame to provide individual flexible circuit boards FK.

Figure 23:
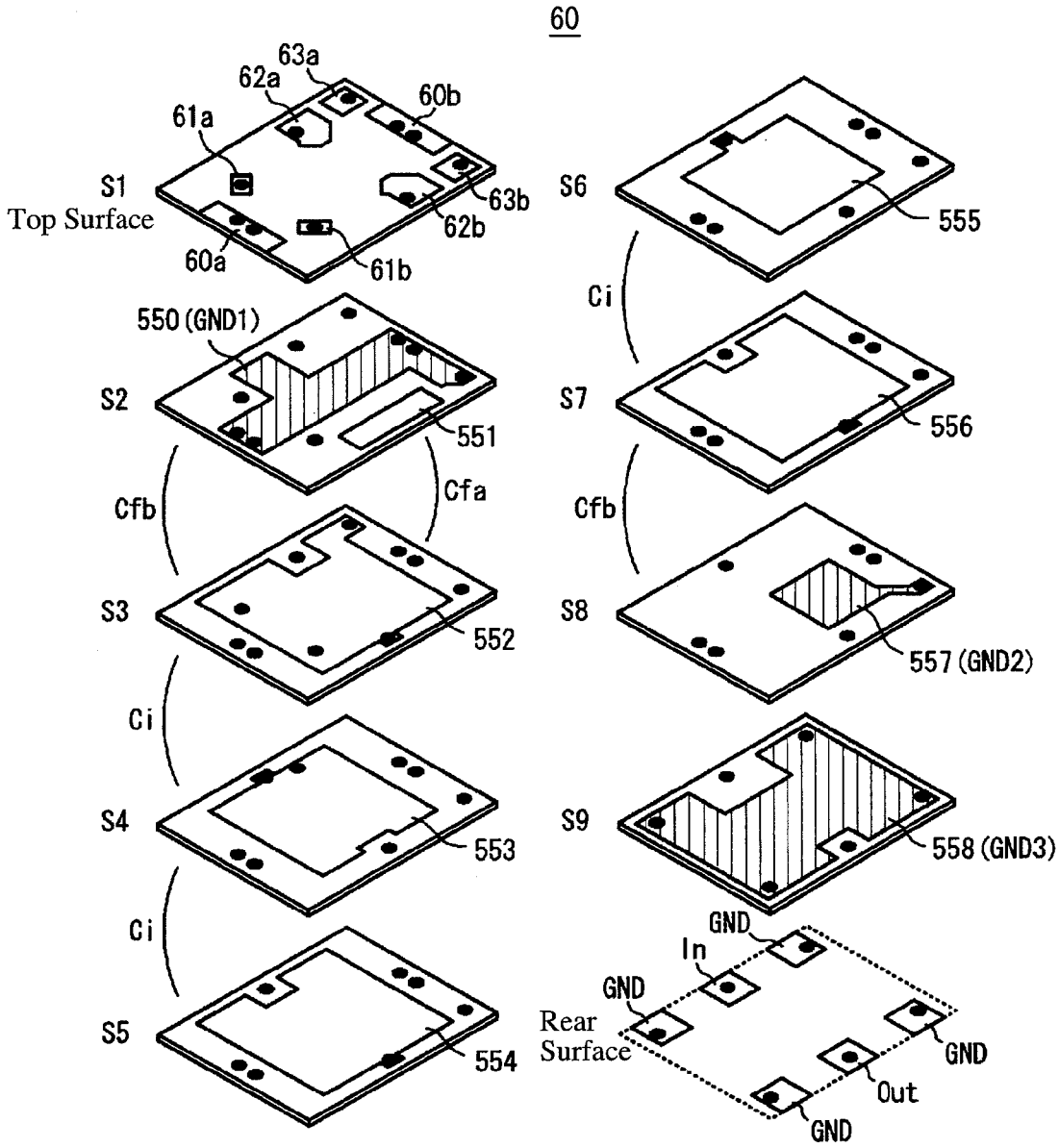
FIG. 23 is an exploded perspective view showing the internal structure of a laminate substrate used in the non-reciprocal circuit device according to the second embodiment of the present invention.

FIG. 23 shows a laminate substrate 60 comprising nine dielectric sheets S1-S9. Each dielectric sheet S1-S9 is printed with a conductive paste to form electrode patterns. The dielectric sheet S1 is provided with electrode patterns 60*a*, 60*b*, 61*a*, 61*b*, 62*a*, 62*b*, 63*a*, 63*b* acting as lands for mounting devices. The dielectric sheet S2 is provided with an electrode pattern 550 (GND1) and an electrode pattern 551. The dielectric sheet S3 is provided with an electrode pattern 552, the dielectric sheet S4 is provided with an electrode pattern 553, the dielectric sheet S5 is provided with an electrode pattern 554, the dielectric sheet S6 is provided with an electrode pattern 555, the dielectric sheet S7 is provided with an electrode pattern 556, the dielectric sheet S8 is provided with an electrode pattern 557 (GND2), and the dielectric sheet S9 is provided with an electrode pattern 558 (GND3).

The electrode patterns on the dielectric sheets S1-S9 are electrically connected through via-holes (shown by black circles in the figure) filled with a conductive paste. As a result, the electrode patterns 552, 553, 554, 555, 556 constitute the first capacitance element Ci, the electrode patterns 551, 552 constitute the second capacitance element Cfa, and the electrode patterns GND1, 552 and electrode patterns 556, 557 constitute the third capacitance element Cfb.

A lower yoke 80 made of a ferromagnetic material like the upper yoke 70 comprises substantially I-shaped end portions 80*a*, 80*b*, and a center portion 80*c* having a relatively large area for disposing the central conductor assembly 30. The lower yoke 80 is received in the upper yoke 70 to constitute a magnetic circuit enclosing the permanent magnet 40 and the central conductor assembly 30.

The upper and lower yokes 70, 80 are preferably provided with high-conductivity plating of Ag, Cu, Au, Al or their alloys. The high-conductivity plating may have the same thickness and electric resistivity as above. With such structure, electromagnetic noise is prevented from penetrating into the yoke, thereby reducing loss.

FIG. 21 shows a non-reciprocal circuit device, in which an upper yoke 70 and a permanent magnet 40 are not depicted. Pluralities of electrode patterns formed on the dielectric sheet S1 appear on a main surface of the laminate substrate 60. The lower yoke 80 is disposed between the electrode patterns 60*a*, 60*b*, and the end portions 80*a*, 80*b* of the lower yoke 80 are soldered to the electrode patterns 60*a*, 60*b* of the laminate substrate 60. A chip resistor R is mounted by soldering between the electrode patterns 62*a*, 63*a*, and a chip inductor Lg constituting the third inductance element is mounted by soldering between the electrode patterns 62*b*, 63*b*.

The central conductor assembly 30 is disposed on a center portion 80*c* of the lower yoke 80, and the first central conductor 21 has an end portion 21*a* soldered to the electrode pattern 61*b* and an end portion 21*b* soldered to the electrode pattern 62*a*. The second central conductor 22 has an end portion 22*a* soldered to the electrode pattern 61*a* and an end portion 22*b* soldered to the electrode pattern 62*b*. The laminate substrate 60 is received in the upper yoke 70 to which the permanent magnet 40 is adhered, with lower ends of the sidewalls of the upper yoke 70 soldered to the electrode patterns 60*a*, 60*b*.

An input terminal IN(P1) and an output terminal OUT (P2) are formed on a rear surface of the laminate substrate 60 with a ground terminal GND disposed therebetween. Each terminal IN(P1), OUT (P2) is formed as a land grid array (LGA) by an electrode pattern, and connected to the electrode patterns in the laminate substrate 60 through via-holes, and to the central conductors, the mounted devices, etc.

Example 2

An ultra-small non-reciprocal circuit device of 2.5 mm×2.0 mm×1.2 mm for a frequency band of 830-840 MHz shown in FIGS. 20-24 was produced. The sizes of devices used in this non-reciprocal circuit device are as follows.

Microwave ferrite 20: garnet of 1.0 mm×1.0 mm×0.15 mm.

Permanent magnet: rectangular La—Co ferrite magnet of 2.0 mm×1.5 mm×0.25 mm.

Central conductors: first and second central conductors 21, 22 of copper formed by etching a 15-μm-thick copper plating layer on both surfaces of a 20-μm-thick, heat-resistant, insulating polyimide sheet, each central conductor 21, 22 having semi-gloss Ag plating of 1-4 μm in thickness.

Laminate substrate 60: 2.5 mm×2.0 mm×0.3 mm (a first capacitance element Ci had capacitance of 32 pF, and a second capacitance element had capacitance of 22 pF).

Chip devices: a 0603-size, 60-Ω resistor, and a 0603-size, 1.2-nH chip inductor.

The measurement of off-band attenuation characteristics, insertion loss and isolation by a network analyzer revealed that this non-reciprocal circuit device had comparable VSWR (at P1) and isolation characteristics to those of the conventional ones, and improved insertion loss and VSWR (at P2), indicating excellent high-frequency characteristics.

EFFECT OF THE INVENTION

The non-reciprocal circuit device of the present invention has a wide operation frequency band (passband) and excellent insertion loss characteristics and reflection characteristics, thereby making input impedance matching easy. Accordingly, when disposed between a power amplifier and an antenna in a transmission system of a mobile communications equipment, it prevents unnecessary signals from returning to the power amplifier, thereby stabilizing the impedance of the power amplifier on the load side. Thus, the non-reciprocal circuit device of the present invention extends battery life in cell phones, etc.

What is claimed is:

1. A non-reciprocal circuit device comprising a first inductance element L1 disposed between a first input/output port P1 and a second input/output port P2, a first capacitance element Ci parallel-connected to said first inductance element L1 to constitute a first resonance circuit, a resistance element R parallel-connected to said first parallel resonance circuit, a second inductance element L2 disposed between a second input/output port P2 of said first resonance circuit and a ground, and a second capacitance element Cfa parallel-connected to said second inductance element L2 to constitute a second resonance circuit, and a third inductance element Lg disposed between said second resonance circuit and the ground, and a third capacitance element Cfb disposed between a second input/output port P2 of said first resonance circuit and the ground.

2. The non-reciprocal circuit device according to claim 1, wherein said first inductance element L1 has smaller inductance than that of said second inductance element L2.

3. The non-reciprocal circuit device according to claim 1, wherein at least one of the first capacitance element Ci, the second capacitance element Cfa and the third capacitance element Cfb is constituted by pluralities of parallel-connected capacitors.

4. The non-reciprocal circuit device according to claim 1, wherein said third inductance element Lg is constituted by an electrode pattern in the laminate substrate, a chip inductor or a coreless coil mounted on the laminate substrate.

5. The non-reciprocal circuit device according to claim 1, wherein an impedance-adjusting means is disposed on the side of the first input/output port P1 of said first resonance circuit.

6. The non-reciprocal circuit device according to claim 5, wherein said impedance-adjusting means is constituted by an inductance element and/or a capacitance element.

7. The non-reciprocal circuit device according to claim 6, wherein said impedance-adjusting means is a lowpass or highpass filter.

8. The non-reciprocal circuit device according to claim 1, wherein said first and second inductance elements L1, L2 are constituted by the first and second central conductors 21, 22 on a ferrimagnetic body 10.

9. The non-reciprocal circuit device according to claim 8, wherein at least part of said first or second capacitance element Ci, Cfa is constituted by an electrode pattern in said laminate substrate, a chip capacitor, or a single-layer capacitor.

10. The non-reciprocal circuit device according to claim 8, wherein said third capacitance element Cfb is constituted by an electrode pattern in said laminate substrate, a chip capacitor, or a single-layer capacitor.

11. The non-reciprocal circuit device according claim 8, wherein an inductance element and/or a capacitance element for said impedance-adjusting means are constituted by electrode patterns in said laminate substrate, or devices mounted on said laminate substrate.

* * * * *